US009518438B2

(12) United States Patent
Sun et al.

(10) Patent No.: US 9,518,438 B2
(45) Date of Patent: Dec. 13, 2016

(54) HIGH TEMPERATURE PACKERS

(71) Applicants: Kai Sun, Missouri City, TX (US); Thomas Gary Corbett, Willis, TX (US)

(72) Inventors: Kai Sun, Missouri City, TX (US); Thomas Gary Corbett, Willis, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 425 days.

(21) Appl. No.: 13/962,045

(22) Filed: Aug. 8, 2013

(65) Prior Publication Data

US 2014/0041858 A1 Feb. 13, 2014

Related U.S. Application Data

(60) Provisional application No. 61/681,207, filed on Aug. 9, 2012, provisional application No. 61/810,097, filed on Apr. 9, 2013.

(51) Int. Cl.
*E21B 33/12* (2006.01)
*E21B 33/128* (2006.01)

(52) U.S. Cl.
CPC ..... *E21B 33/12* (2013.01); *E21B 33/128* (2013.01)

(58) Field of Classification Search
CPC ..... E21B 23/06; E21B 17/10; E21B 33/12
See application file for complete search history.

(56) References Cited

U.S. PATENT DOCUMENTS 4,515,213 A * 5/1985 Rogen ..... E21B 33/1212 166/123
5,199,497 A * 4/1993 Ross ..... E21B 23/00 148/402
2007/0163777 A1* 7/2007 Murray ..... E21B 33/1216 166/179
2009/0294124 A1* 12/2009 Patel ..... E21B 47/09 166/255.2
2010/0078173 A1* 4/2010 Buytaert ..... E21B 17/1014 166/302
2011/0240286 A1* 10/2011 Williams ..... E21B 41/00 166/207
2012/0175845 A1 7/2012 Duan et al.

FOREIGN PATENT DOCUMENTS

WO 01/92682 12/2001

OTHER PUBLICATIONS

PCT International Search Report and Written Opinion for PCT/US2013/054080 dated Nov. 12, 2014, 15 pages.

* cited by examiner

*Primary Examiner* — Giovanna C Wright
(74) *Attorney, Agent, or Firm* — Paul Anderson

(57) ABSTRACT

Self-initialized packers for use in high temperature steam injection applications in wellbores are provided. The packers include an actuating mechanism for setting a packing element for sealing within an openhole or cased hole. The actuating mechanism includes an actuator sleeve that includes an actuating element constructed from a shape memory alloy that has a transformation temperature range greater than a geothermal temperature of the wellbore, and is actuated upon heating from steam injection. Systems and methods of using the packers are also provided.

29 Claims, 10 Drawing Sheets

HIGH TEMPERATURE PACKERS

CROSS-REFERENCE TO RELATED APPLICATIONS

This application claims priority to U.S. Provisional Application No. 61/681,207, entitled "High Temperature Packers," filed on Aug. 9, 2012, and to U.S. Provisional Application No. 61/810,097, entitled "High Temperature Packers," filed on Apr. 9, 2013. The complete disclosures of the above-identified applications are hereby fully incorporated herein by reference.

TECHNICAL FIELD

The present application relates generally to downhole tools, and more particularly, to self-initialized packers actuated by a shape memory alloy during high temperature steam injection in a wellbore.

BACKGROUND

In steam injection applications for oil reservoirs, in order to increase sweep efficiency in long steam injection wells, and thereby increase oil recovery, it is desirable for the steam to be distributed "equally" along an inclined, horizontal, or vertical openhole section. However, due to reservoir heterogeneity and cumulative friction pressure drop along the openhole wellbore, the steam will generally flow unevenly along the formation, thus leading to poor sweep efficiency.

Currently, there are a number of downhole outflow control technologies that can be introduced in injection applications. For instance, outflow control tools can be used to create back-pressure between the annular space and inner space of completion strings, and thereby affect injection pressure along the wellbore (the annulus pressure) in an attempt to "equalize" the injection profile. This technology generally utilizes openhole packers, such as swellable packers, to isolate the long horizontal wellbore into multiple injection units. Swellable packers have a swellable elastomer bonded thereto that, when deployed downhole and subjected to an activating agent (such as water, oil, or both), swells on the packer and eventually engages a surrounding sidewall of the openhole. However, conventional swellable packers have been shown to provide inadequate sealing under high temperature (above 400° F.) conditions due to temperature degradation of the packing element.

Therefore, there is a need for a reliable packer suitable for use under high temperature conditions for steam injection outflow control applications.

SUMMARY

The present application is directed to systems and apparatus for steam injection utilizing a temperature actuated self-initializing openhole packer.

One aspect of the invention relates to a packer for use in a wellbore. The packer includes a housing having a cavity extending therethrough, a packing element positionable between a normal state and a set state and coupled to an exterior of the housing, and an actuating mechanism for transitioning the packing element from the normal state to the setting state. Generally, the actuating mechanism includes an actuating element constructed from a shape memory alloy, such as copper-aluminum-nickel, nickel-titanium-platinum, nickel-titanium-palladium, or nickel-titanium Another aspect of the invention relates to an actuator sleeve for actuating a packer for use in a wellbore. The actuator sleeve includes a housing having at least one channel in a wall of the housing, and one or more actuating elements positioned within the channel(s). The actuating element(s) transition from a compressed normal state to an elongated set state, where a portion of the actuating element(s) exits an end of the housing when in the elongated set state. Generally, the actuating element comprises a shape memory alloy.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings.

BRIEF DESCRIPTION OF THE DRAWINGS

For a more complete understanding of the exemplary embodiments of the present invention and the advantages thereof, reference is now made to the following description in conjunction with the accompanying drawings, which are briefly described as follows.

DESCRIPTION OF THE EXEMPLARY EMBODIMENTS

Figure 1A:
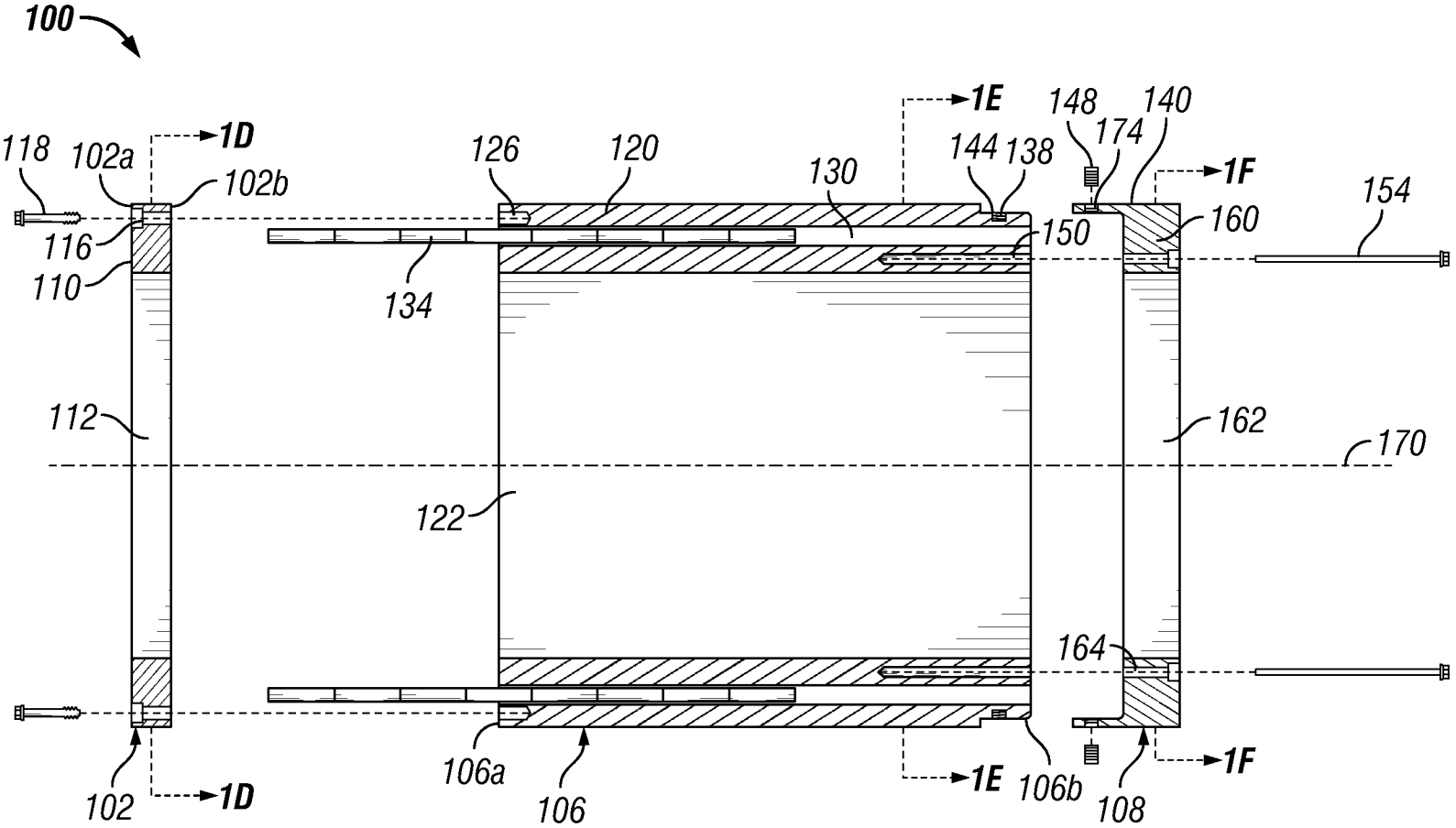
FIG. 1A is an exploded side cross-sectional view of an actuator sleeve, according to an exemplary embodiment.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention may be better understood by reading the following description of non-limitative embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for instance, a meaning other than that understood by skilled artisans, such a special definition will be expressly set forth in the specification in a definitional manner that directly and unequivocally provides the special definition for the term or phrase. In the following description of the representative embodiments of the invention, directional terms, such as "above", "below", "upper", "lower", "top", "bottom", etc., are used for convenience in referring to the accompanying drawings. In general, "above", "upper", "upward", "top" and similar terms refer to a direction toward the earth's surface along a wellbore, and "below", "lower", "downward", "bottom" and similar terms refer to a direction away from the earth's surface along the wellbore.

The present application is generally directed to steam injection systems utilizing a high temperature, temperature actuated self-initializing openhole packer. Referring to FIGS. 1A-1F, an exemplary embodiment of an actuator sleeve 100 for actuating an openhole packer 200 (FIGS. 2A-2D) is shown. The actuator sleeve 100 includes an outer cup 102, an actuator housing 106, and an inner cup 108. The outer cup 102 includes a generally cylindrical wall 110 and an opening 112 extending from a first end 102*a* to a second end 102*b*. The wall 110 includes a plurality of holes 116 configured to receive a fastening mechanism, such as set screws 118, therein. In certain exemplary embodiments, the holes 116 are spaced evenly apart in the wall 110. In other embodiments, the holes 116 can be spaced unevenly apart. In certain exemplary embodiments, the outer cup 102 is coupled to the actuator housing 106 by way of the set screws 118. In alternative embodiments, the outer cup 102 can be threadably coupled to the actuator housing 106. In yet other embodiments, the outer cup 102 can be welded to the actuator housing 106 prior to inserting actuating elements 134 into the actuator housing 106.

The actuator housing 106 includes a generally cylindrical wall 120 and an opening 122 extending from a first end 106*a* to a second end 106*b*. The opening 122 is configured to align with the opening 112 of the outer cup 102. In certain exemplary embodiments, the wall 120 includes a plurality of threaded holes 126 positioned within the first end 106*a* of the wall 120 and configured to align with the holes 116 in the outer cup 102 and receive the set screws 118 therein. The actuator housing 106 includes a plurality of channels 130 within the wall 120 extending from the first end 106*a* to the second end 106*b*. In certain alternative embodiments, the channels 130 extend from the second end 106*b* to a position away from the first end 106*a*. The channels 130 are configured to each receive an actuating element 134 therein. In certain exemplary embodiments, the actuating element 134 is cylindrical or bar-shaped. Generally, the actuating element 134 can have any cross-sectional shape that corresponds to a cross-sectional shape of the channels 130. The actuator housing 106 also includes a recess 138 along an exterior of the cylindrical wall 120 at the second end 106*b*. The recess 138 is configured to receive an extension 140 of the inner cup 108. The recess 138 also includes a threaded groove 144 for receiving a shear screw 148 therein for coupling the inner cup 108 to the actuator housing 106. The wall 120 also includes a plurality of holes 150 positioned within the second end 106*b* for each receiving an anti-rotation guide bar 154 therein. In certain exemplary embodiments, the wall 120 includes four holes 150 spaced 90 degrees apart.

The inner cup 108 includes a generally cylindrical wall 160 and an opening 162 extending through a center thereof. In certain exemplary embodiments, the wall 160 also includes a plurality of openings 164 configured to align with the holes 150 in the actuator housing 106 and for receiving the anti-rotation guide bars 154 therein. Once coupled, the anti-rotation guide bars 154 function to prevent rotation between the inner cup 108 and the actuator housing 106. The anti-rotation guide bars 154 can hold any potential shearing force resulting from rotation of the inner cup 108 with respect to the actuator housing 106 resulting from any inconsistent extension of the actuating element 134 within the channels 130, and therefore protect the actuating elements 134 from being exposed to the shear force. The extension 140 extends from the wall 160 in a direction parallel to a central axis 170. The extension 140 is configured to engage the recess 138 on the actuator housing 106. The extension 140 includes a plurality of holes 174 for receiving the shear screws 148 therein for coupling the inner cup 108 to the actuator housing 106.

Generally, the actuating element 134 is constructed of a shape memory alloy. Generally, shape memory alloys are smart materials that have the ability to return to a predetermined shape when heated. In exemplary embodiments, the shape memory alloy has a transformation temperature greater than the initial wellbore geothermal temperature of from about 100 to about 450° F. In certain exemplary embodiments, the shape memory alloy has a transformation temperature pre-designed with an exact temperature within 200° F. to 450° F. range depending on the well formation temperature gradient, formation depth, and the injected steam temperature. In certain exemplary embodiments, the actuating element 134 is constructed of a copper-aluminum-nickel (Cu—Al—Ni) shape memory alloy. The Cu—Al—Ni shape memory has a transformation temperature window of about −240 to about 480° F., a maximum recovery strain of about 9 percent, a maximum recovery stress of about 72,500 pounds per square inch (psi), about 5,000 transformation cycles, a density of about 7.1 grams/centimeters$^3$, an admissible stress of about 14,500 psi for actuator cycling, an ultimate tensile strength of about 73,000 to about 116,000 psi, and good corrosion resistance. In certain alternative embodiments, the actuating element 134 is constructed of a nickel-titanium-platinum (Ni—Ti—Pt) shape memory alloy. The transformation temperature of the Ni—Ti—Pt shape memory alloy can be as high as 1100° F., depending on how much platinum is added. In certain other embodiments, the actuating element 134 is constructed of a nickel-titanium-palladium (Ni—Ti—Pd) shape memory alloy. The transformation temperature of the Ni—Ti—Pd shape memory alloy can be as high as 1300° F., depending on how much palladium is added. For shallow wells with a low bottomhole temperature, the shape memory alloy nickel-titanium (Ni—Ti) or nitinol can also be used to construct the actuating element 134, however, its transformation temperature can only be as high as around 230° F. For high bottomhole temperature wells, such as wellbores having a temperature close to or higher than its transformation temperature, nitinol is unsuitable for use in these applications because this wellbore temperature may cause the actuator to pre-actuate undesirably before heating up.

Figure 1B:
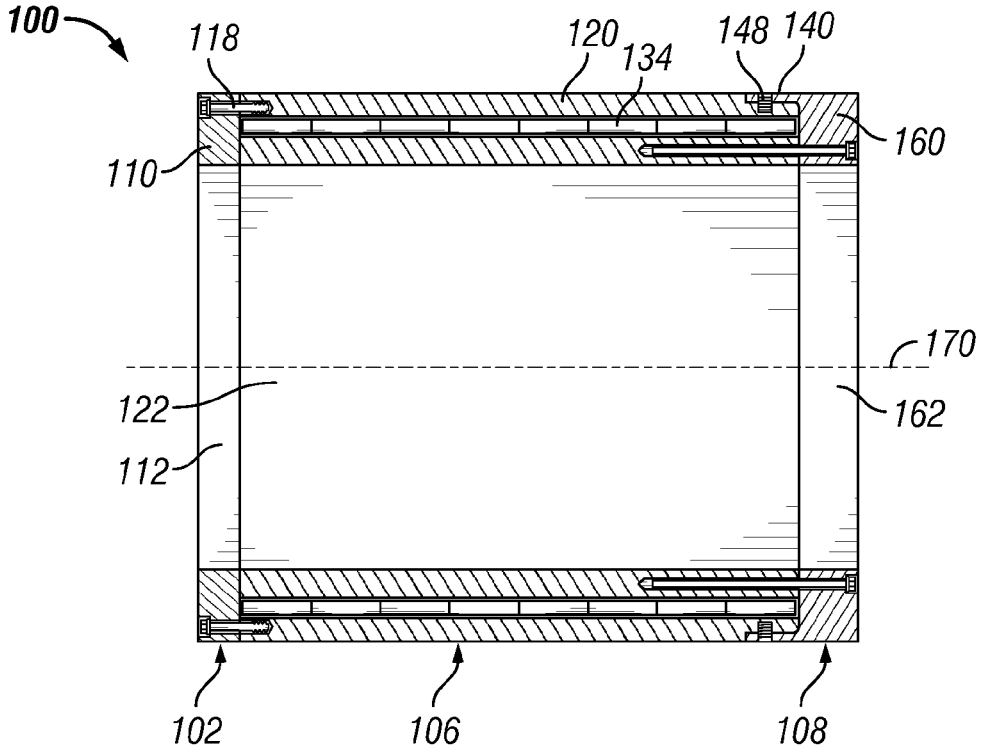
FIG. 1B is a side cross-sectional view of the actuator sleeve of FIG. 1A, before actuation, according to an exemplary embodiment.
Figure 1C:
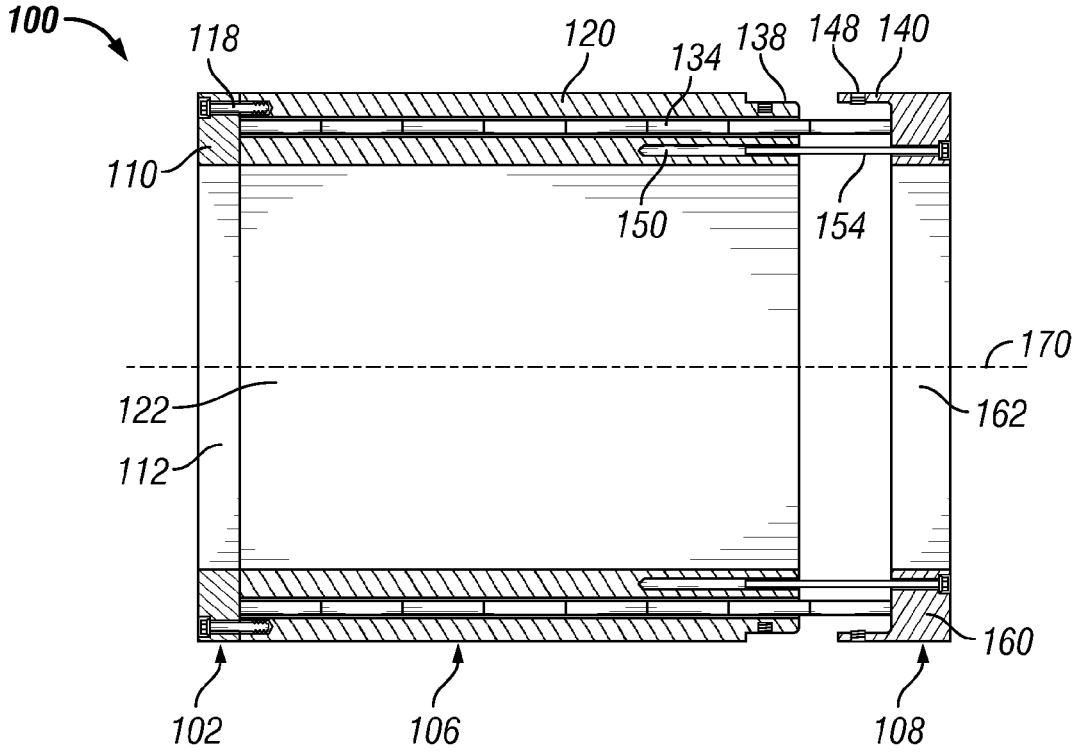
FIG. 1C is a side cross-sectional view of the actuator sleeve of FIG. 1A, after actuation, according to an exemplary embodiment.
Figure 1D:
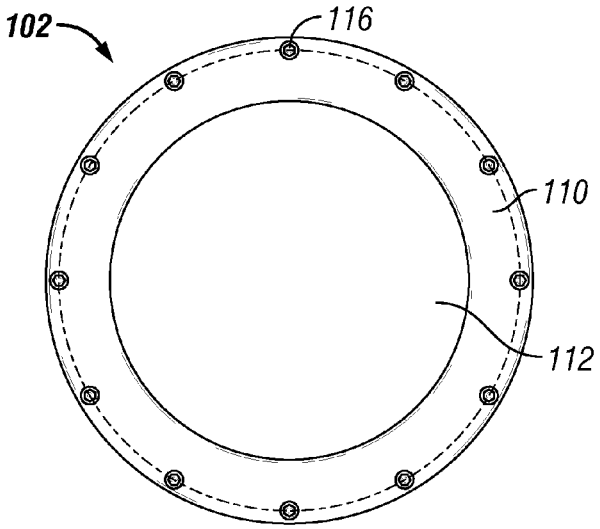
FIG. 1D is a cross-sectional view of an outer cup of the actuator sleeve of FIG. 1A, taken along section 1D-1D, according to an exemplary embodiment.
Figure 1E:
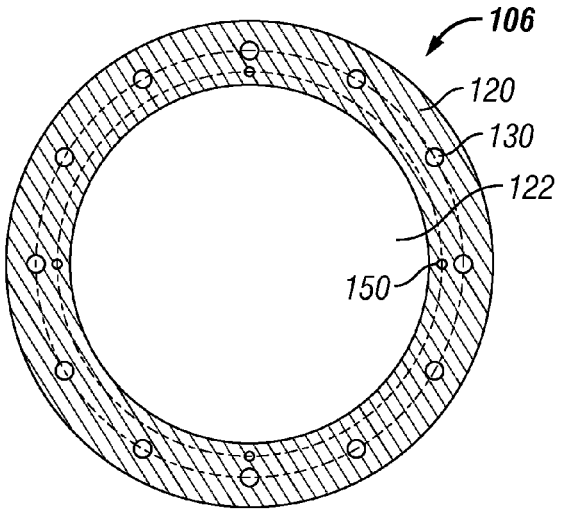
FIG. 1E is a cross-sectional view of an actuator housing of the actuator sleeve of FIG. 1A, taken along section 1E-1E, according to an exemplary embodiment.
Figure 1F:
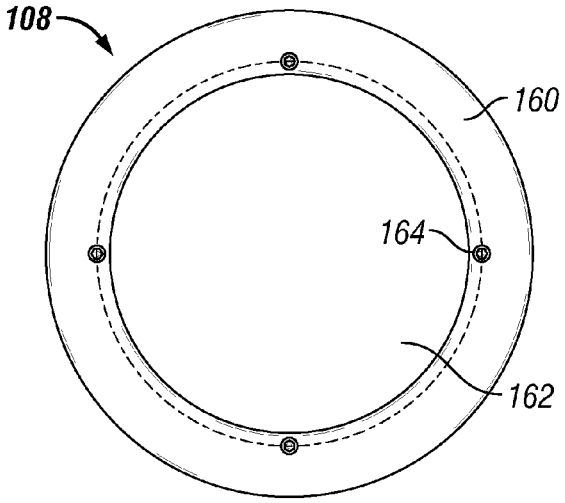
FIG. 1F is a cross-sectional view of an inner cup of the actuator sleeve of FIG. 1A, taken along section 1F-1F, according to an exemplary embodiment.

When the shape memory alloy of the actuating elements 134 is cold, or below its transformation temperature, it has a low yield strength and can be deformed quite easily into any new shape, which it will retain, as shown in FIG. 1B. However, when the material is heated, such as from steam or electricity through an electric cable, to above its transformation temperature, the material undergoes a change in crystal structure, which causes it to return to its original shape, as shown in FIG. 1C. During its phase transformation, the shape memory alloy generates a large force against any encountered resistance or undergoes a significant dimension change when unrestricted. Referring to FIG. 1B, prior to actuating the actuator sleeve 100, the actuating elements 134 are in a first state such that the actuating elements 134 are positioned within the channels 130 and the inner cup 108 is coupled to the actuator housing 106. Referring to FIG. 1C, when the actuating elements 134 are exposed to a temperature above its transformation temperature, the shape of the actuating elements 134 transforms to a second state. In the present application, the shape memory alloy is compressed with a predetermined amount of force. The recovery force of the shape memory alloy can be released most efficiently by heating the shape memory alloy to above the transformation temperature to let the actuating elements 134 elongate back to its original position to release the recovery force. In the second state, the ends of the actuating elements 134 at the second end 106*b* shifts towards the inner cup 108, thereby exerting a force sufficient to shear the shear screws 148 and allow the inner cup 108 to move away from the actuator housing 106, and thus actuating the actuator sleeve 100.

Referring to FIGS. 2A-2D, an exemplary embodiment of an openhole packer 200 is shown. The packer 200 includes a cylindrical housing or mandrel 202 having a cavity 204 extending therethrough. An exterior surface 206 of the mandrel 202 includes two channels 210 spaced apart by an extension 212. In certain exemplary embodiments, each of the channels 210 extends circumferentially around the mandrel 202 surface 206. Each channel 210 includes a ledge 216 at an end opposite from the extension 212. An actuator sleeve 100 (FIGS. 1A-1F) sits within each of the channels 210. A fixed locking element 224 is positioned between the ledge 216 and the extension 212, above the actuator sleeve 100. The locking element 224 includes a guide slot 226 therein. In certain exemplary embodiments, the locking element 224 includes a locking mechanism, such as teeth 228, on a side opposite from the actuator sleeve 100. A movable piston 230 is positioned adjacent to the locking element 224 on the side opposite from the actuator sleeve 100. The movable piston 230 includes a locking mechanism, such as teeth 232, configured to engage the teeth 228 of the locking element 224. In certain exemplary embodiments, a shear screw 234 is used to keep the movable piston 230 fixed to locking element 224 when the actuating elements 134 in the actuator sleeve 100 are in a compressed phase prior to actuation. In certain alternative embodiments, the shear screws 234 can be replaced with a shear ring (not shown) to help prevent oversetting of the packer 200. In certain other embodiments, a shear ring is used in addition to the shear screws 234 to control the setting force on the packer 200 and prevent overset, especially when the packer 200 setting stroke length is variable. When heat is applied and a setting force is applied via the actuating elements 134, the shear screws 234 are sheared first, and then if the setting force is continued to be applied, the shear ring will then shear to prevent overset. In certain exemplary embodiments, the addition of the shear ring provides flexibility to use the packer 200 in inconsistently sized boreholes, especially in openhole conditions.

A plate 236 is fixedly coupled to the end of the locking element 224 opposite from the extension 212. In certain exemplary embodiments, a load transfer extension 238 is coupled to the movable piston 230 and extends through the guide slot 226. The plate 236 is stationary and positioned such that the load transfer extension 238 extends past the plate 236 and can move within the guide slot 226. On the end opposite from the plate 236, an anti-extrusion ring 230*a* is coupled to the movable piston 230. The anti-extrusion ring 230*a* is adjacent to a packing element 240 that is positioned atop the extension 212, to prevent extrusion damage of the packing element 240 during a pack-off process. Suitable examples of materials for constructing the packing element 240 include, but are not limited to, expanding metal, corrugated metal, high temperature range elastomers such as Kalrez®, Chemraz®, swellable packing elements, and other sealing materials suitable for high temperature well applications.

Figure 2A:
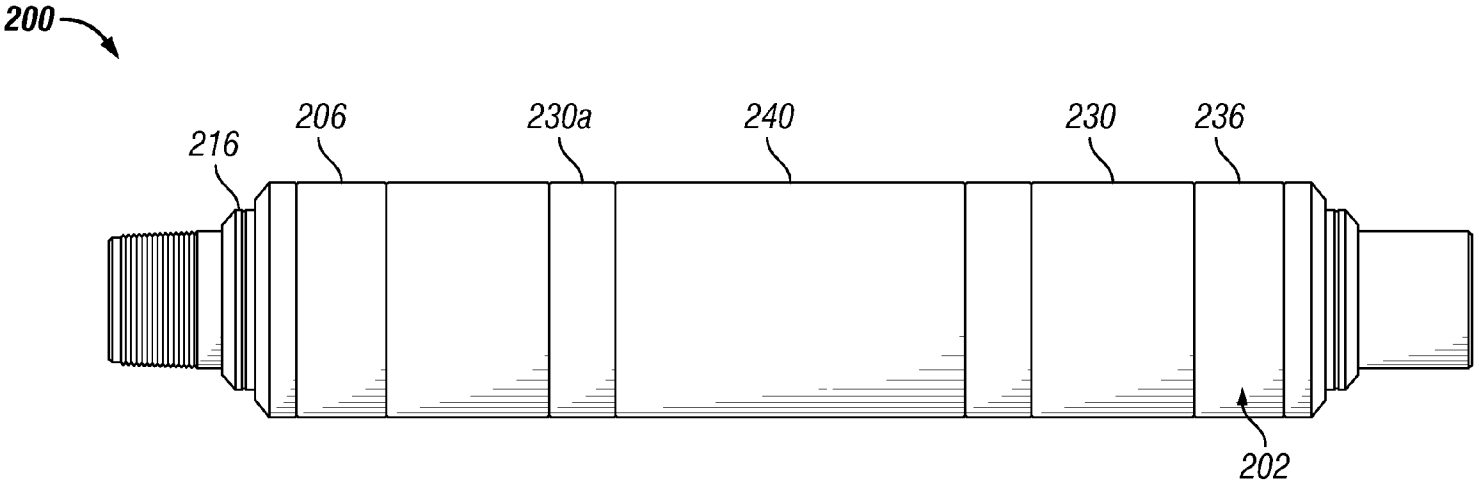
FIG. 2A is a side view of an openhole packer, before actuation, according to an exemplary embodiment.
Figure 2B:
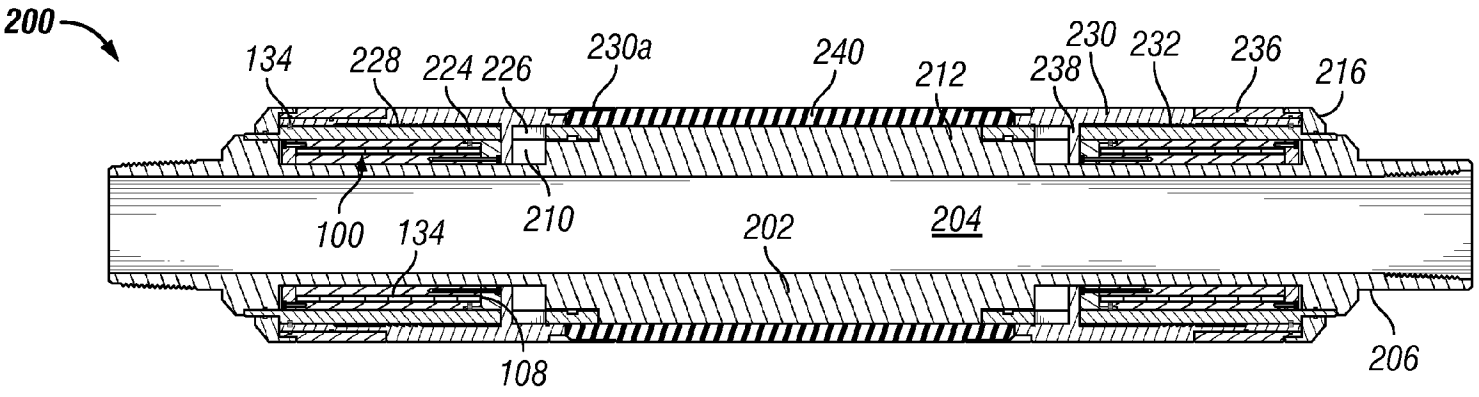
FIG. 2B is a side cross-sectional view of the openhole packer of FIG. 2A, according to an exemplary embodiment.
Figure 2C:
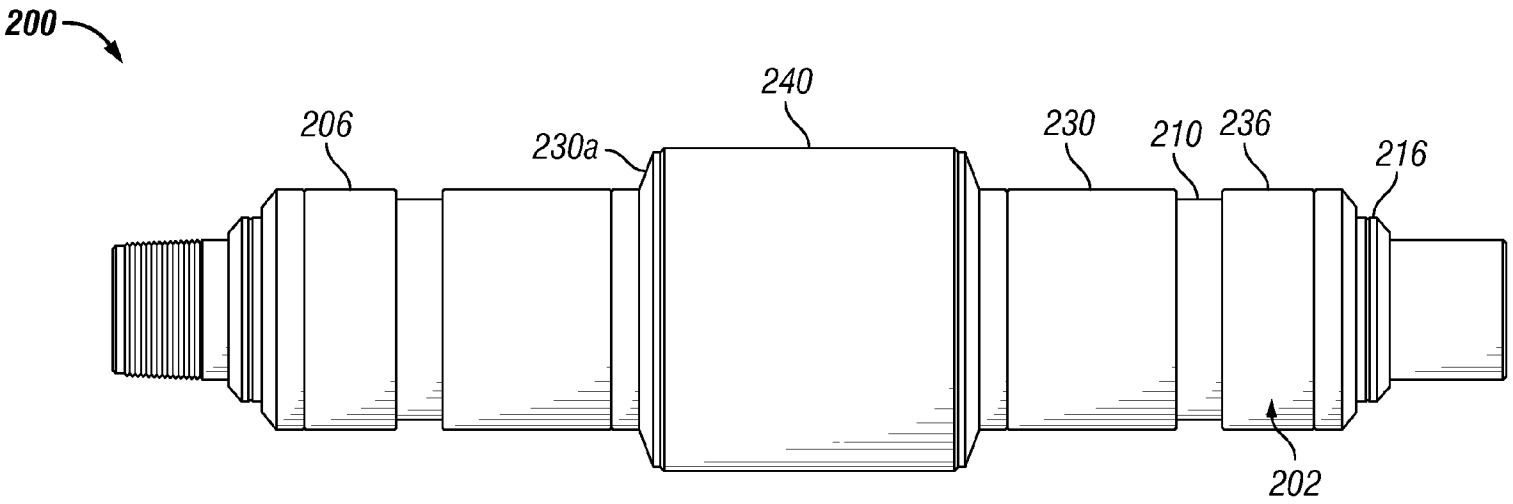
FIG. 2C is a side view of the openhole packer of FIG. 2A, after actuation, according to an exemplary embodiment.
Figure 2D:
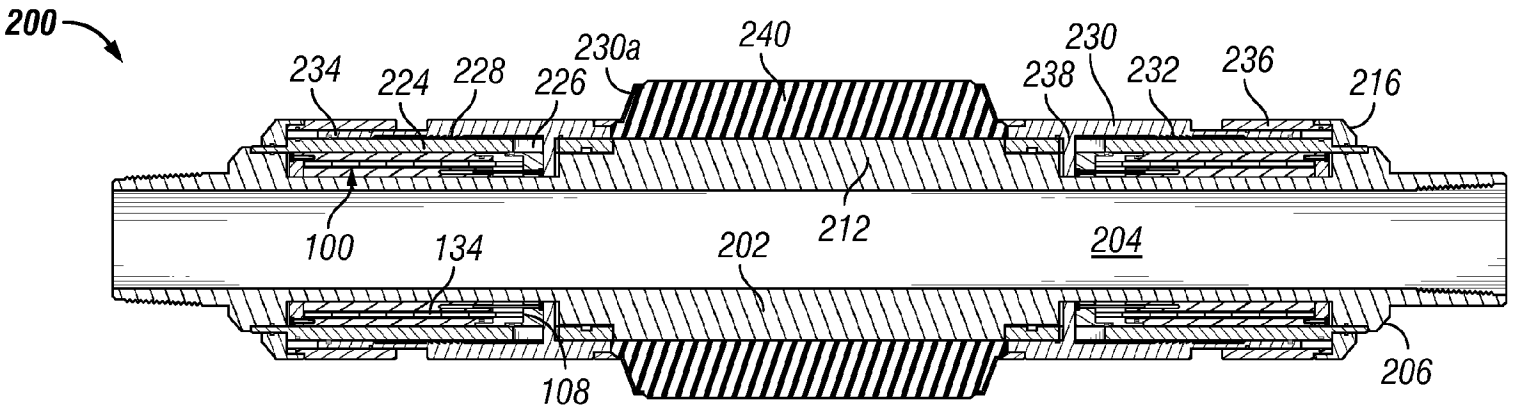
FIG. 2D is a side cross-sectional view of the openhole packer of FIG. 2C, according to an exemplary embodiment.

Heat, such as from steam or electricity through an electric cable, can be injected into the well. Through thermal conduction of the mandrel 202, the actuating element 134 in the actuator sleeve 100 will be ultimately heated. Examples of suitable materials for construction of the actuating element 134 include shape memory alloys having a stable transition or transformation temperature to actuate the packer 200, a recovery stress to set the packer 200, and a recovery strain to ensure enough stroke length to expand the packing element 240. Referring to FIGS. 2A and 2B, prior to actuating the packer 200, the actuator sleeve 100 is in a first state such that the load transfer extension 238 is positioned within the guide slot 226 towards the ledge 216, and the movable piston 230 is also positioned towards the ledge 216. Referring to FIGS. 2C and 2D, when the actuating element 134 is exposed to a temperature above its transformation temperature, the shape of the actuating element 134 transforms to the second state, whereby the actuating element 134 elongates and shifts the inner cup 108 towards the extension 212, and produces a force sufficient to shear the shear screws 234. Upon shearing of the shear screws 234, the movable piston 230 shifts towards the extension 212, thereby causing the load transfer extension 238 to shift within the guide slot 226. The movement of the load transfer extension 238 also shifts the movable piston 230 towards the extension 212 such that each of the anti-extrusion rings 230*a* force the packing element 240 to compress and set. In certain exemplary embodiments, the load transfer extension 238 is a mechanism to transfer the load from the actuator sleeve 100 to the movable piston 230. Once the packer 200 is actuated, the teeth 228 of locking element 224 engage the teeth 232 of the movable piston 230 and lock the packing element 240 in place.

Figure 3A:
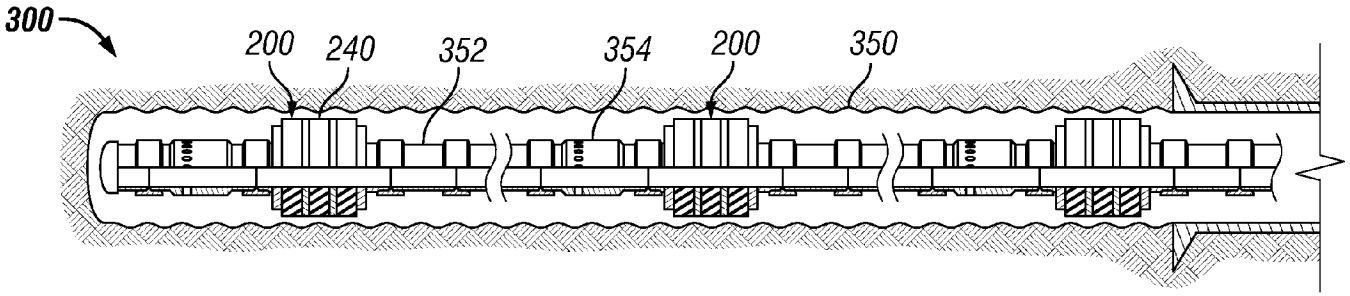
FIG. 3A is a side view of a wellbore system utilizing the openhole packer of FIG. 2A, before actuation, according to an exemplary embodiment.
Figure 3B:
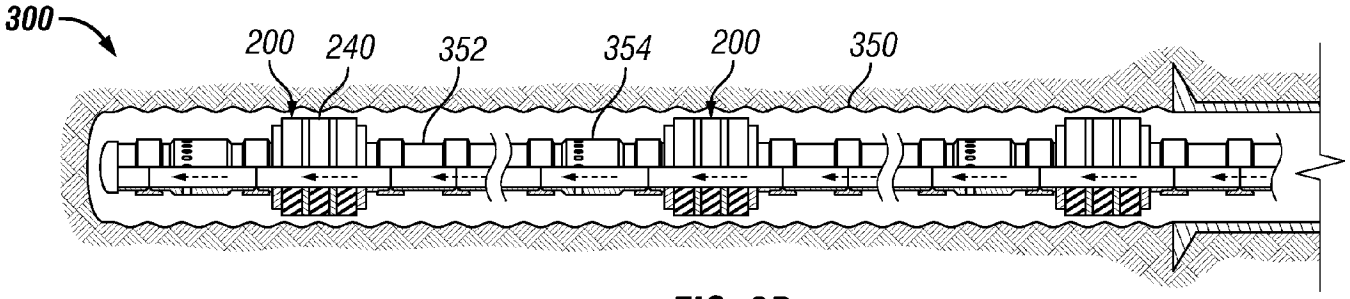
FIG. 3B is a side view of the wellbore system of FIG. 3A, during actuation, according to an exemplary embodiment.
Figure 3C:
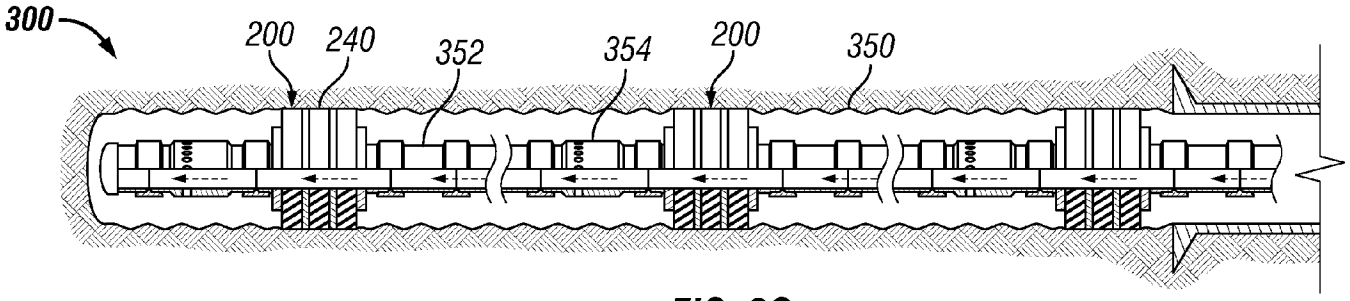
FIG. 3C is a side view of the wellbore system of FIG. 3A, after actuation, according to an exemplary embodiment.

FIGS. 3A-3C show a system 300 utilizing the openhole packer 200 in a wellbore 350 exposed to geothermal temperatures. Referring to FIG. 3A, completion string 352, outflow control equipment 354, and openhole packers 200 are run in the wellbore 350. In certain exemplary embodiments, the openhole packers 200 are spaced apart in the wellbore 350. Referring to FIG. 3B, steam is injected into the wellbore 350 through the tubing or the annulus space to gradually increase the temperature of the wellbore 350. Referring to FIG. 3C, once the temperature increases to above a transformation starting temperature (As) of the actuating element 134 (FIG. 1A-1C), the actuator sleeves 100 (FIGS. 1A-1C) are actuated and the setting process for the packers 200 is started. Continuing steam injection into the wellbore 350 increases the temperature of the wellbore 350, and once the temperature increases to above a transformation ending temperature (Af) of the actuating element 134, actuation of the actuator sleeve 100 is completed and the packers 200 subsequently set. In certain exemplary embodiments, the packers 200 are actuated at temperatures above 300° F. or 400° F. The packers 200 include locking mechanisms, such as teeth 228, 232 (FIGS. 2B, 2D), to lock the packing elements 240 of packers 200 in place.

Referring to FIGS. 4A-4D, another exemplary embodiment of an openhole packer 400 is shown. The packer 400 includes a cylindrical housing or mandrel 402 having a cavity 404 extending therethrough. An exterior surface 406 of the mandrel 402 includes two channels 410 spaced apart by an extension 412. In certain exemplary embodiments, each of the channels 410 extends circumferentially around the mandrel 402 surface 406. Each channel 410 includes a ledge 416 at an end opposite from the extension 412. An actuating element or actuator 420 sits within each of the channels 410. In certain exemplary embodiments, the actuator 420 is cylindrical or bar-shaped. In certain embodiments, the actuator 420 is fixed at the end of the channel 410 adjacent to the extension 412, and is detached at the end of the channel 410 adjacent to the ledge 416. A fixed locking element 424 is positioned between the ledge 416 and the extension 412, above the actuator 420. The locking element 424 includes a guide slot 426 therein. In certain exemplary embodiments, the locking element 424 includes a locking mechanism, such as teeth 428, on a side opposite from the actuator 420. A movable piston 430 is positioned adjacent to the locking element 424 on the side opposite from the actuator 420. The movable piston 430 includes a locking mechanism, such as teeth 432, configured to engage the teeth 428 of the locking element 424. In certain exemplary embodiments, a set screw 434 is used to keep the actuator 420 in a strain phase position prior to actuation. A plate 436 is fixedly coupled to the end of the locking element 424 opposite from the extension 412. In certain exemplary embodiments, a load transfer rod 438 is coupled to the actuator 420 and the movable piston 430 and extends through the guide slot 426. The plate 436 is stationary and positioned such that the load transfer rod 438 is below the plate 436 and can move within the guide slot 426. On the end opposite from the plate 436, an anti-extrusion ring 430*a* is coupled to the movable piston 430. The anti-extrusion ring 430*a* is adjacent to a packing element 440, similar to packing element 240, which is positioned atop the extension 412, to prevent extrusion damage of the packing element 440 during a pack-off process.

Heat, such as from steam or electricity through an electric cable, can be injected into the well. Through thermal conduction of the mandrel 402, the actuator 420 will be ultimately heated. The actuator 420 is constructed of a shape memory alloy, as described previously. Examples of suitable materials for construction of the actuator 420 include shape memory alloys having a stable transition or transformation temperature to actuate the packer 400, a recovery stress to set the packer 400, and a recovery strain to ensure enough stroke length to expand the packing element 440. In some embodiments, the actuator 420 is constructed of a copper-aluminum-nickel (Cu—Al—Ni) shape memory alloy. Constructing the actuator 420 from a Cu—Al—Ni shape memory alloy allows for about 5 inches of movement of the packing element 440 for every 56 inches of actuator 420 length, and about 50,000 pounds-force to set the packing element 440 for a 0.7 inches$^2$ cross-sectional area of the actuator 420.

Figure 4A:
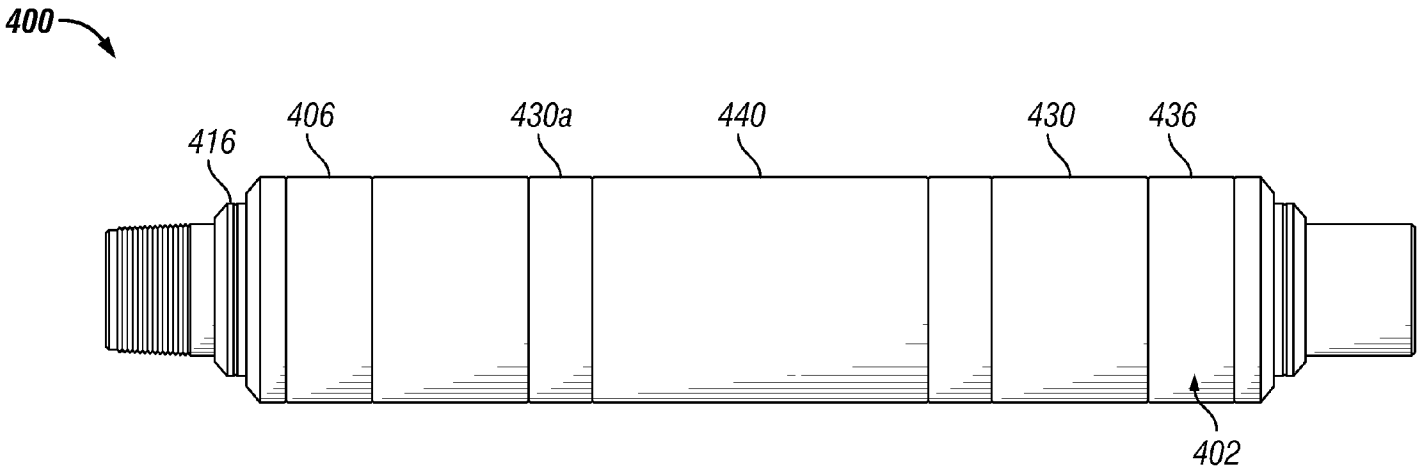
FIG. 4A is a side view of an openhole packer, before actuation, according to another exemplary embodiment.
Figure 4B:
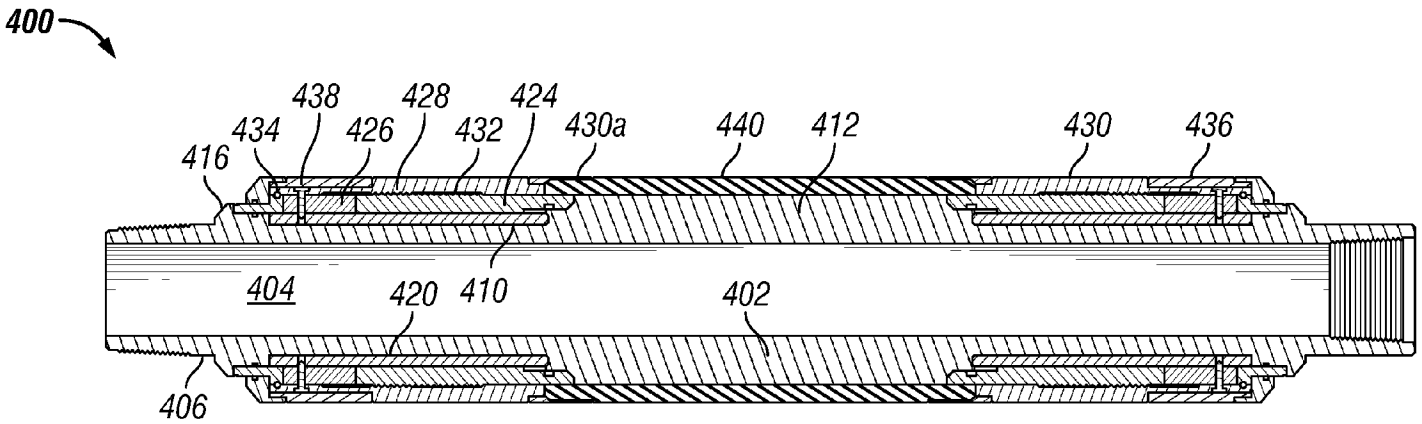
FIG. 4B is a side cross-sectional view of the openhole packer of FIG. 4A, according to an exemplary embodiment.
Figure 4C:
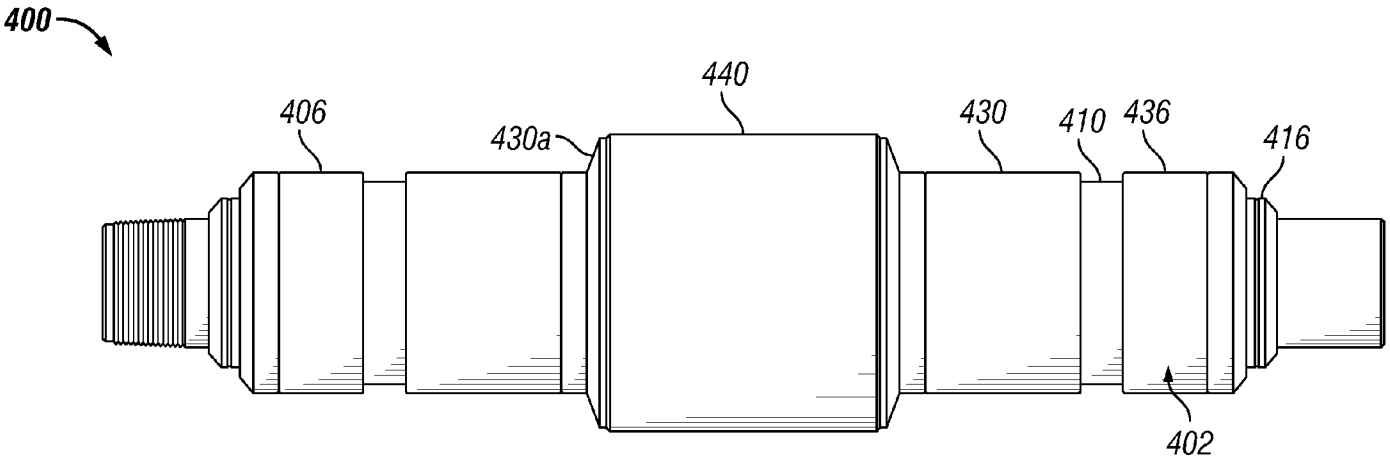
FIG. 4C is a side view of the openhole packer of FIG. 4A, after actuation, according to an exemplary embodiment.
Figure 4D:
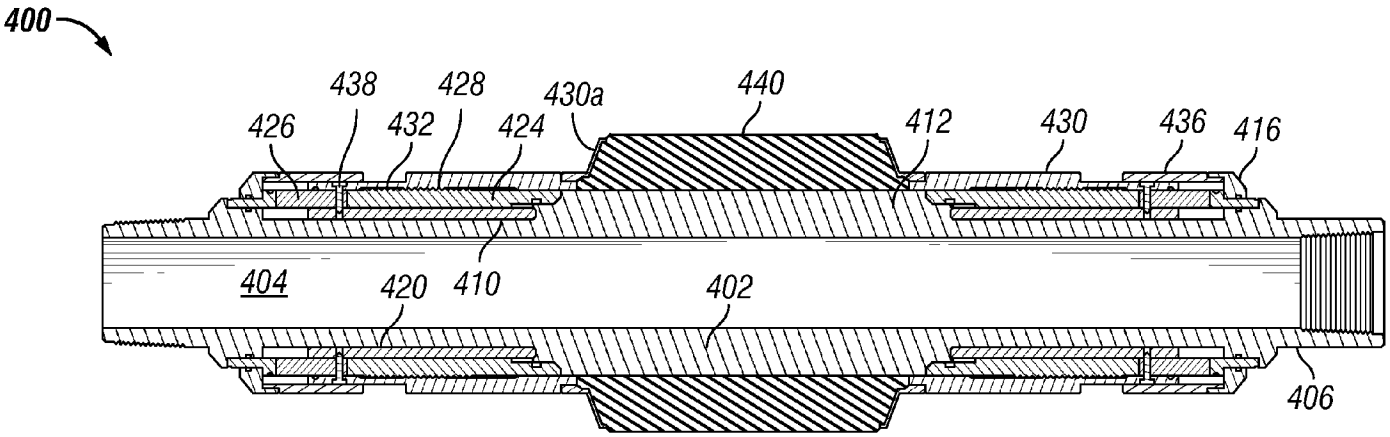
FIG. 4D is a side cross-sectional view of the openhole packer of FIG. 4C, according to an exemplary embodiment.

Referring to FIGS. 4A and 4B, prior to actuating the packer 400, the actuator 420 is in a first state such that the load transfer rod 438 is positioned within the guide slot 426 towards the ledge 416, and the movable piston 430 is also positioned towards the ledge 416. Referring to FIGS. 4C and 4D, when the actuator 420 is exposed to a temperature above its transformation temperature, the shape of the actuator 420 transforms to a second state. In the present application, the shape memory alloy is stretched with a predetermined amount of force. The recovery force of the shape memory alloy can be released most efficiently by heating the shape memory alloy to above the transformation temperature to let the actuator 420 shrink back to its original position to release the recovery force. In the second state, the end of the actuator 420 detached from the channel 410 shifts towards the extension 412, thereby causing the load transfer rod 438 coupled to the actuator 420 to shift within the guide slot 426. The movement of the load transfer rod 438 also shifts the movable piston 430 towards the extension 412 such that each of the anti-extrusion ring 430*a* force the packing element 440 to compress and set. In certain exemplary embodiments, the load transfer rod 438 is a mechanism to transfer the load from the actuator 420 to the movable piston 430. Once the packer 400 is actuated, the teeth 428 of locking element 424 engage the teeth 432 of the movable piston 430 and lock the packing element 440 in place. This locking mechanism prevents the packer 400 from releasing, even if the shape memory alloy becomes softer upon the temperature cooling down or if the internal stress of the packing element 440 pushes the shape memory alloy into a strain phase.

Figure 5A:
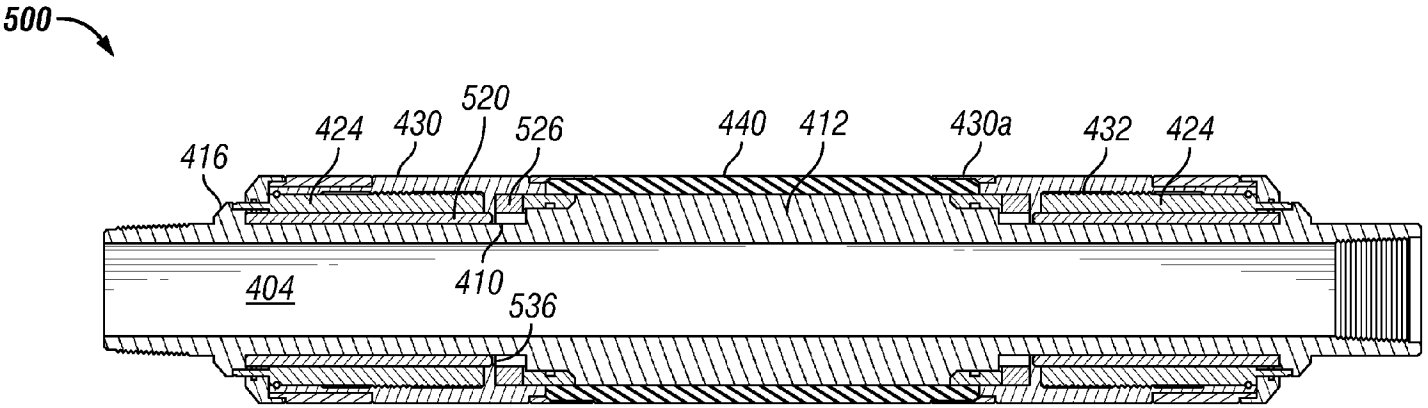
FIG. 5A is a side cross-sectional view of an openhole packer, before actuation, according to yet another exemplary embodiment.
Figure 5B:
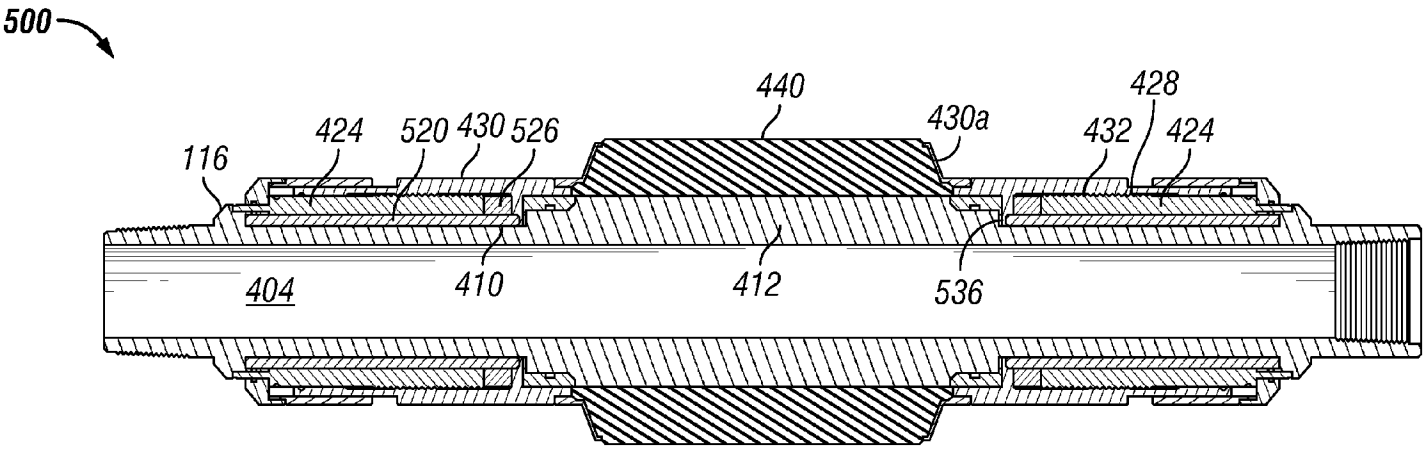
FIG. 5B is a side cross-sectional view of the openhole packer of FIG. 5A, after actuation, according to an exemplary embodiment.

FIGS. 5A and 5B show an openhole packer 500 according to yet another exemplary embodiment. The openhole packer 500 is the same as that described above with regard to openhole packer 400, except as specifically stated below.

For the sake of brevity, the similarities will not be repeated hereinbelow. Referring now to FIGS. 5A and 5B, an actuating element or actuator 520 is fixed at the end of the channel 410 adjacent to the ledge 416. The actuator 520 is constructed of a shape memory alloy, as described above. The locking element 424 includes a guide slot 526 that is positioned proximate to the extension 412. The movable piston 430 includes a stop element 536 that extends downward through the guide slot 526 and towards the channel 410, and abuts an end of the actuator 520 to keep the actuator 520 in a compressed state. In certain exemplary embodiments, the actuator 520 is coupled to the stop element 536. When heat is injected into the cavity 404 and the actuator 520 is exposed to a temperature above its transformation temperature, the shape of the actuator 520 transforms such that the end abutting the stop element 536 shifts towards the extension 412, thereby causing the stop element 536 coupled to the actuator 520 to shift within the guide slot 526. The movement of the stop element 536 also shifts the movable piston 430 towards the extension 412 such that each of the anti-extrusion ring 430*a* force the packing element 440 to compress and set. Once the packer 500 is actuated, the teeth 428 of locking element 424 engage the teeth 432 of the movable piston 430 and lock the packing element 440 in place.

Figure 6A:
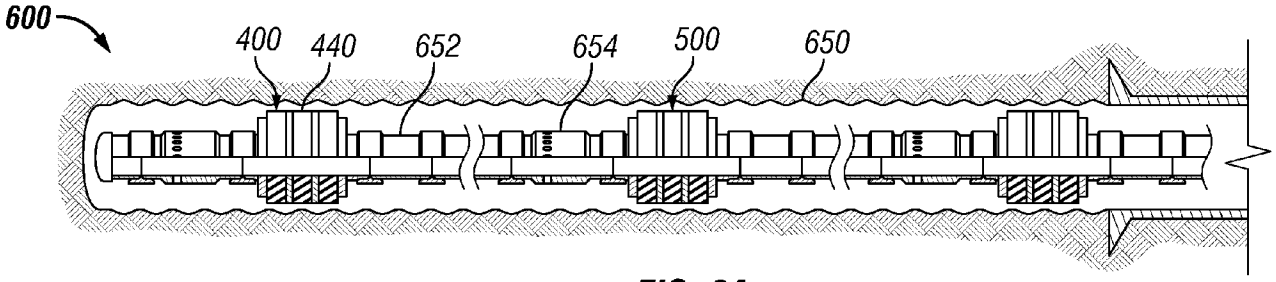
FIG. 6A is a side view of a wellbore system utilizing the openhole packers of FIGS. 4A and 5A, before actuation, according to an exemplary embodiment.
Figure 6B:
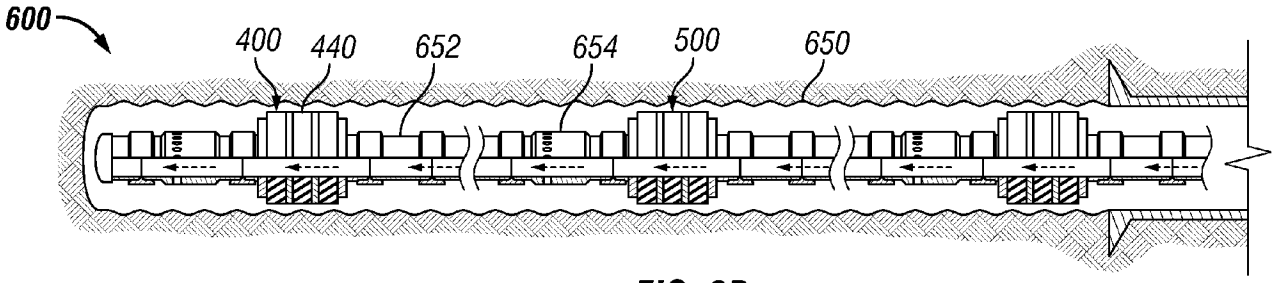
FIG. 6B is a side view of the wellbore system of FIG. 6A, during actuation, according to an exemplary embodiment.
Figure 6C:
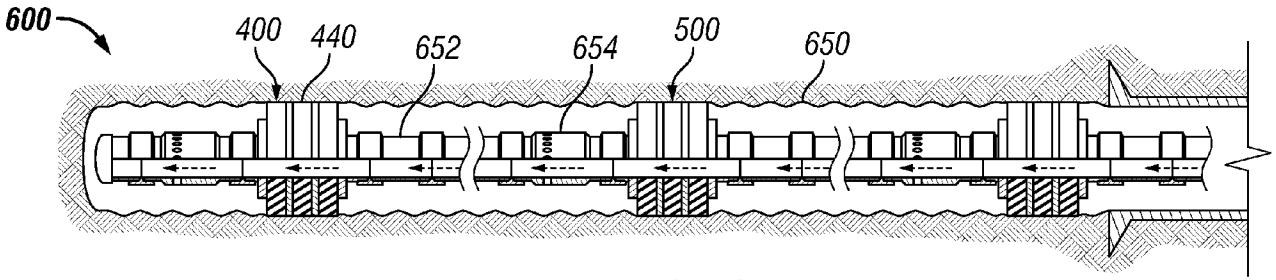
FIG. 6C is a side view of the wellbore system of FIG. 6A, after actuation, according to an exemplary embodiment.

FIGS. 6A-6C show a system 600 utilizing the openhole packers 400, 500 in a wellbore 650 exposed to geothermal temperatures. Referring to FIG. 6A, completion string 652, outflow control equipment 654, and openhole packers 400, 500 are run in the wellbore 650. In certain exemplary embodiments, the openhole packers 400, 500 are spaced apart in the wellbore 650. In certain embodiments, the packers used in the wellbore 650 are all the same type of packer. In certain other embodiments, the packers used in the wellbore 650 include a mixture of packers 400, 500. Referring to FIG. 6B, steam is injected into the wellbore 650 through the tubing or the annulus space which gradually increases the temperature of the wellbore 650. Referring to FIG. 6C, once the temperature increases to above the transformation starting temperature (As) of the actuators 420, 520 (FIGS. 4D, 5B), the packers 400, 500 are actuated and setting process is started. Continuing steam injection into the wellbore 650 increases the temperature of the wellbore 650, and once the temperature increases to above the transformation ending temperature (Af) of the actuators 420, 520, the packers 400, 500 are fully actuated and subsequently set. In certain exemplary embodiments, the packers 400, 500 are actuated at temperatures above 300° F. or 400° F. The packers 400, 500 include locking mechanisms, such as teeth 428, 432 (FIGS. 4D, 5B), to lock the packing elements 440 of packers 400, 500 in place.

The present application is generally directed to steam injection systems utilizing a high temperature, temperature actuated self-initializing openhole packer and associated methods. The exemplary systems may include an openhole packer having an actuating element constructed from a shape memory alloy having a transformation temperature greater than about 200° F. The openhole packers of the present invention are advantageous over conventional openhole packers for a number of reasons. For instance, the actuation and setting mechanism of the present packers can be readily controlled by steam injection, and without intervention or service tools to set the packers, which is convenient for the operators and reduces risks associated with setting conventional packers. Also, the packing element setting period is much shorter when compared to conventional swellable packers since the phase transformation of the shape memory alloys of the actuators occurs almost immediately after the actuating elements are heated to above their transformation temperature, whereas conventional swellable packers may take several days for complete setting. In addition, the present packers can exhibit improved sealing capabilities because high temperature sealing and packing materials such as expanding metal, corrugated metal, Kalrez®, Chemraz®, swellable packing elements, or others can be chosen specially for this packer design with the aid of a large force generated by the transformation of the actuating element.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment. While numerous changes may be made by those skilled in the art, such changes are encompassed within the spirit of this invention as defined by the appended claims. For instance, each packer may include only one actuating element thereon to compress the packing element from one direction. In addition, the packers and the described actuation methods may be applied in a cased hole environment. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee

What is claimed is:

1. A packer for use in a wellbore, comprising:

a housing having a cavity extending therethrough;

a packing element coupled to an exterior of the housing, the packing element positionable between a normal state and a set state; and an actuating mechanism for transitioning the packing element from the normal state to the setting state, wherein the actuating mechanism comprises an actuating element constructed from a shape memory alloy, wherein the actuating mechanism further comprises a piston movable between a first piston position and a second piston position, wherein when the piston is in the first piston position, the packing element is in the normal state, and wherein when the piston is in the second piston position, the packing element is in the set state.

2. The packer of claim 1, wherein the actuating element has a transformation starting temperature in a range of between about 100 to about 450 degrees Fahrenheit, and the actuating element has a transformation ending temperature in a range of between about 150 to about 600 degrees Fahrenheit.

3. The packer of claim 1, wherein the actuating element has a transformation starting temperature in a range of between about 200 to about 450 degrees Fahrenheit, and the actuating element has a transformation ending temperature in a range of between about 250 to about 600 degrees Fahrenheit.

4. The packer of claim 1, wherein the actuating element has a transformation starting temperature and a transformation ending temperature greater than a geothermal temperature of the wellbore.

5. The packer of claim 1, wherein the actuating element is cylindrical or bar-shaped.

6. The packer of claim 1, wherein the actuating element is in an elongated state at a temperature below the actuating element's transformation starting temperature, and contracts to impart a setting force to the packer when heated to a temperature above the actuating element's transformation starting temperature.

7. The packer of claim 1, wherein the actuating element is in a compressed state at a temperature below the actuating element's transformation starting temperature, and elongates to impart a setting force to the packer when heated to a temperature above the actuating element's transformation starting temperature.

8. The packer of claim 1, wherein the actuating element is fully actuated and the packing element is in the set state when the actuating element is heated to a temperature above the actuating element's transformation ending temperature.

9. The packer of claim 1, wherein the shape memory alloy is heated by steam injection to a temperature above the actuating element's transformation temperature.

10. The packer of claim 1, wherein the shape memory alloy is selected from the group consisting of copper-aluminum-nickel, nickel-titanium-platinum, nickel-titanium-palladium, and nickel-titanium.

11. The packer of claim 1, wherein the shape memory alloy has a recovery strain in the range of from about 5 to about 9 percent.

12. The packer of claim 1, wherein the actuating mechanism includes an actuator sleeve comprising:

an actuator housing having a wall and a housing cavity extending therethrough, the actuator housing having a first end and a second end, the actuator housing having at least one channel therein, wherein the at least one channel is open to the second end; and an actuating element positioned within the channel of the actuator housing, wherein the actuating element transitions from a normal state to a set state, wherein the actuating element comprises a shape memory alloy.

13. The packer of claim 12, wherein the at least one channel extends through the wall from the first end to the second end.

14. The packer of claim 12, further comprising an outer cup coupled to the first end of the housing.

15. The packer of claim 12, further comprising an inner cup coupled to the second end of the housing, the inner cup positionable between a normal state and a set state.

16. The packer of claim 15, wherein when the one or more actuating elements are in the set state, the inner cup is in the set state.

17. The packer of claim 16, wherein when the inner cup is in the set state, the inner cup transfers a portion of a load exerted by the one or more actuating elements to set the packing element.

18. The packer of claim 1, wherein the actuating mechanism further comprises a locking element coupled to the housing, wherein the locking element comprises a locking mechanism, and wherein the piston comprises a locking mechanism configured to engage the locking mechanism of the locking element and lock the packing element in the set state.

19. The packer of claim 18, wherein the locking element comprises a guide slot, wherein the actuating mechanism comprises a load transfer mechanism coupled to the piston and movable within the guide slot.

20. The packer of claim 1, wherein the actuating mechanism further comprises a shearing mechanism for preventing oversetting of the packer, wherein the shearing mechanism is a shear screw or a shear ring.

21. An actuator sleeve for actuating a packer for use in a wellbore, the actuator sleeve comprising:

a housing having a wall and a housing cavity extending therethrough, the housing having a first end and a second end, the housing having at least one channel therein, wherein the at least one channel is open to the second end;

one or more actuating elements, wherein the actuating elements are positioned within the at least one channel of the housing, wherein the one or more actuating elements transitions from a compressed normal state to an elongated set state, wherein a portion of the one or more actuating elements exits the second end when in the elongated set state, wherein the actuating element comprises a shape memory alloy; and an inner cup having an inner cup cavity extending therethrough, the inner cup coupled to the second end of the housing, wherein the housing cavity is aligned with the inner cup cavity, the inner cup positionable between a normal state and a set state, wherein the wall of the housing and the inner cup further comprise one or more grooves for receiving anti-rotation guide bars therein, wherein the anti-rotation guide bars prevent rotation of the inner cup with respect to the housing when the inner cup is in the set state.

22. The actuator sleeve of claim 21, wherein the at least one channel extends through the wall from the first end to the second end.

23. The actuator sleeve of claim 21, further comprising an outer cup having an outer cup cavity extending therethrough, the outer cup coupled to the first end of the housing, wherein the housing cavity is aligned with the outer cup cavity.

24. The actuator sleeve of claim 21, wherein when the one or more actuating elements are in the elongated set state, the inner cup is in the set state.

25. The actuator sleeve of claim 21, wherein when the inner cup is in the set state, the inner cup transfers a portion of a load exerted by the one or more actuating elements in the elongated set state.

26. The actuator sleeve of claim 21, wherein the actuating element is in a compressed state at a temperature below the actuating element's transformation starting temperature, and elongates to impart a force to the inner cup when heated to a temperature above the actuating element's transformation starting temperature.

27. The actuator sleeve of claim 21, wherein the shape memory alloy is selected from the group consisting of copper-aluminum-nickel, nickel-titanium-platinum, nickel-titanium-palladium, and nickel-titanium.

28. An actuator sleeve for actuating a packer for use in a wellbore, the actuator sleeve comprising:

a housing having a wall and a housing cavity extending therethrough, the housing having a first end and a second end, the housing having at least one channel therein, wherein the at least one channel is open to the second end;

one or more actuating elements, wherein the actuating elements are positioned within the at least one channel of the housing, wherein the one or more actuating elements transitions from a compressed normal state to an elongated set state, wherein a portion of the one or more actuating elements exits the second end when in the elongated set state, wherein the actuating element comprises a shape memory alloy; and an inner cup having an inner cup cavity extending therethrough, the inner cup coupled to the second end of the housing, wherein the housing cavity is aligned with the inner cup cavity, the inner cup positionable between a normal state and a set state, wherein the wall of the housing and the inner cup further comprise one or more grooves for receiving shear screws therein, wherein the shear screws shear when the one or more actuating elements transitions from the compressed normal state to the elongated set state, wherein shearing of the shear screws allows the inner cup to transition from the normal state to the set state.

29. The actuator sleeve of claim 28, wherein the shape memory alloy is selected from the group consisting of copper-aluminum-nickel, nickel-titanium-platinum, nickel-titanium-palladium, and nickel-titanium.

* * * * *